US005328168A

United States Patent [19]

Fox

[11] Patent Number: 5,328,168

[45] Date of Patent: Jul. 12, 1994

[54] HIERARCHY OF JAM CLEARANCE OPTIONS INCLUDING SINGLE ZONE CLEARANCE

[75] Inventor: Elizabeth D. Fox, Rochester, N.Y.

[73] Assignee: Xerox Corporation, Stamford, Conn.

[21] Appl. No.: 45,288

[22] Filed: Apr. 12, 1993

[51] Int. Cl.[5] ..... B65H 7/06

[52] U.S. Cl. ..... 271/259; 271/263; 271/265; 271/273; 355/316

[58] Field of Search ..... 271/258, 259, 263, 273; 355/316

[56] References Cited

U.S. PATENT DOCUMENTS 4,170,414 10/1979 Hubert ..... 271/259 X
4,231,567 11/1980 Ziehm ..... 271/259
4,275,879 6/1981 Yamashita et al. ..... 271/259
4,627,711 12/1986 Schron ..... 355/14
4,786,041 1/1988 Acquaviva ..... 271/3.1
5,072,923 12/1991 Coy ..... 271/273 X

*Primary Examiner*—Richard A. Schacher
*Attorney, Agent, or Firm*—Ronald F. Chapuran

[57] ABSTRACT

The method of recovery from a jam of a copy sheet in a clearance zone in an image processing machine including the steps of determining the position of the copy sheet and a following copy sheet in the copy sheet path, recognizing that the following copy sheet is within a second clearance zone, calculating a time period to continue machine operation to drive the following copy sheet into the first clearance zone, and determining that said time period does not exceed a maximum time period.

21 Claims, 6 Drawing Sheets

HIERARCHY OF JAM CLEARANCE OPTIONS INCLUDING SINGLE ZONE CLEARANCE

BACKGROUND OF THE INVENTION

The invention relates to jam clearance and, more particularly, to selective options in jam clearance including the timing control of a copy sheet drive for single zone jam clearance.

In using reproduction machines, there are various types of system shut downs or malfunctions that can occur in a variety of operating modes. Operator involvement in correcting for the malfunction can often be extensive particularly in machines with various accessories such as sorters, collators, finishers and document handlers. The problem of correcting the malfunction, maintaining the integrity of the run in process, and minimizing down time and operator involvement can be significant.

Jam recovery and associated job recovery in many present copiers often requires the removal of documents or copy sheets stopped in several places in the machine even if the jam occurred in only one location to only one document. Jam recovery also often requires the reordering of documents as well as the purging of some or all of copies in process in the machine. This can be a time consuming and inefficient operation.

Various techniques of jam clearance exist in the prior art. For example, U.S. Pat. No. 4,627,711 to Schron, assigned to Xerox Corporation, discloses a control system for controlling the shutdown of a paper path system in a copy machine when a paper handling fault occurs. Upon detecting a malfunction or jam, the control system evaluates the status of all sheets in a sheet handling system and makes determinations whether to hold sheets from entering into a boundary between two zones or to drive a sheet at a boundary into a next zone.

U.S. Pat. No. 4,231,567 to Ziehm, assigned to Xerox Corporation, discloses a method and apparatus for clearing jams in a transport path of a copier. When a jam is sensed, in-process sheets either at a jam location or at an area upstream of the jam location are clustered while sheets downstream from the jam location are allowed to continue out in a catch tray. The jam sheets are removed manually after the last downstream sheet exits the copier and the copier shuts down.

U.S. Pat. No. 4,786,041 to Acquaviva et al., assigned to Xerox Corporation, discloses a document handler jam clearance and job recovery system. Upon the occurrence of a paper jam, the system determines whether a document has jammed in a first, second or third document path jam zone and automatically provides a preliminary job recovery operation before the document handler is fully stopped. Document feeding zones are independently operated to feed unjammed documents in a third jam zone to a stacking tray or to feed unjammed documents in the third jam zone to a stacking tray or to feed unjammed documents in the first jam zone to a platen, so that documents are directed to be operator removed from only one zone.

U.S. Pat. No. 4,275,879 to Yamashita et al. discloses an apparatus for detecting an abnormal paper feed. Upon detecting the occurrence of an abnormal paper feed, the apparatus sends forth an abnormality signal only after all preceding sheets have been processed and delivered to an output stacker from entering into a boundary between two zones or to drive a sheet at a boundary into a next zone.

U.S. Pat. No. 4,231,567 to Ziehm, assigned to Xerox Corporation, discloses a method and apparatus for clearing jams in a transport path of a copier. When a jam is sensed, in-process sheets either at a jam location or at an area upstream of the jam location are clustered while sheets downstream from the jam location are allowed to continue out in a catch tray. The jam sheets are removed manually after the last downstream sheet exits the copier and the copier shuts down.

U.S. Pat. No. 4,786,041 to Acquaviva et al., assigned to Xerox Corporation, discloses a document handler jam clearance and job recovery system. Upon the occurrence of a paper jam, the system determines whether a document has jammed in a first, second or third document path jam zone and automatically provides a preliminary job recovery operation before the document handler is fully stopped. Document feeding zones are independently operated to feed unjammed documents in the third zone to a stacking tray or to feed unjammed documents in the first jam zone to a platen, so that documents are directed to be operator removed from only one zone.

U.S. Pat. No. 4,275,879 to Yamashita et al. discloses an apparatus for detecting an abnormal paper feed. Upon detecting the occurrence of an abnormal paper feed, the apparatus sends forth an abnormality signal only after all preceding sheets have been processed and delivered to an output stacker.

One difficulty in these prior art devices is often the requirement that independent control of more than one copy sheet drive is often required or that the copy sheets need to be independently driven to cluster zones. Another difficulty in prior art devices is that it is often necessary to drive a copy sheet totally into a clearance zone with no leeway for clearance of a copy sheet that may extend into more than one clearance zone. Another difficulty is the necessity of clearing copy sheets from multiple machine locations.

It is an object, therefore, of the present invention to be able to position copy sheets for clearance within a single zone of a copy sheet path by merely controlling the time of operation of a single copy sheet drive after detection of a machine jam. Another object of the present invention is to be able to determine that a copy sheet can be cleared from a single zone even though the copy sheet extends into a neighboring zone. Another object of the present invention is to enable clearance of copy sheets by access to only one zone of the copy sheet path rather than multiple zones even though the copy sheet overlaps multiple zones of the copy sheet path. Other advantages of the present invention will become apparent as the following description proceeds, and the features characterizing the invention will be pointed out with particularity in the claims annexed to and forming a part of this specification.

SUMMARY OF THE INVENTION

A method of recovery from a copy sheet jam wherein a copy sheet extends from a first sheet clearance zone to a second sheet clearance zone, by monitoring the location of the copy sheet within the plurality of zones, responding to a malfunction and to the location of the copy sheet to operate a copy sheet drive a given period of time dependent upon the location of the copy sheet with respect to the zones, and positioning the copy sheet within the copy sheet path for access from one of the zones depending upon the location of, the copy sheet and the degree of restraint of the copy sheet within the zones.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
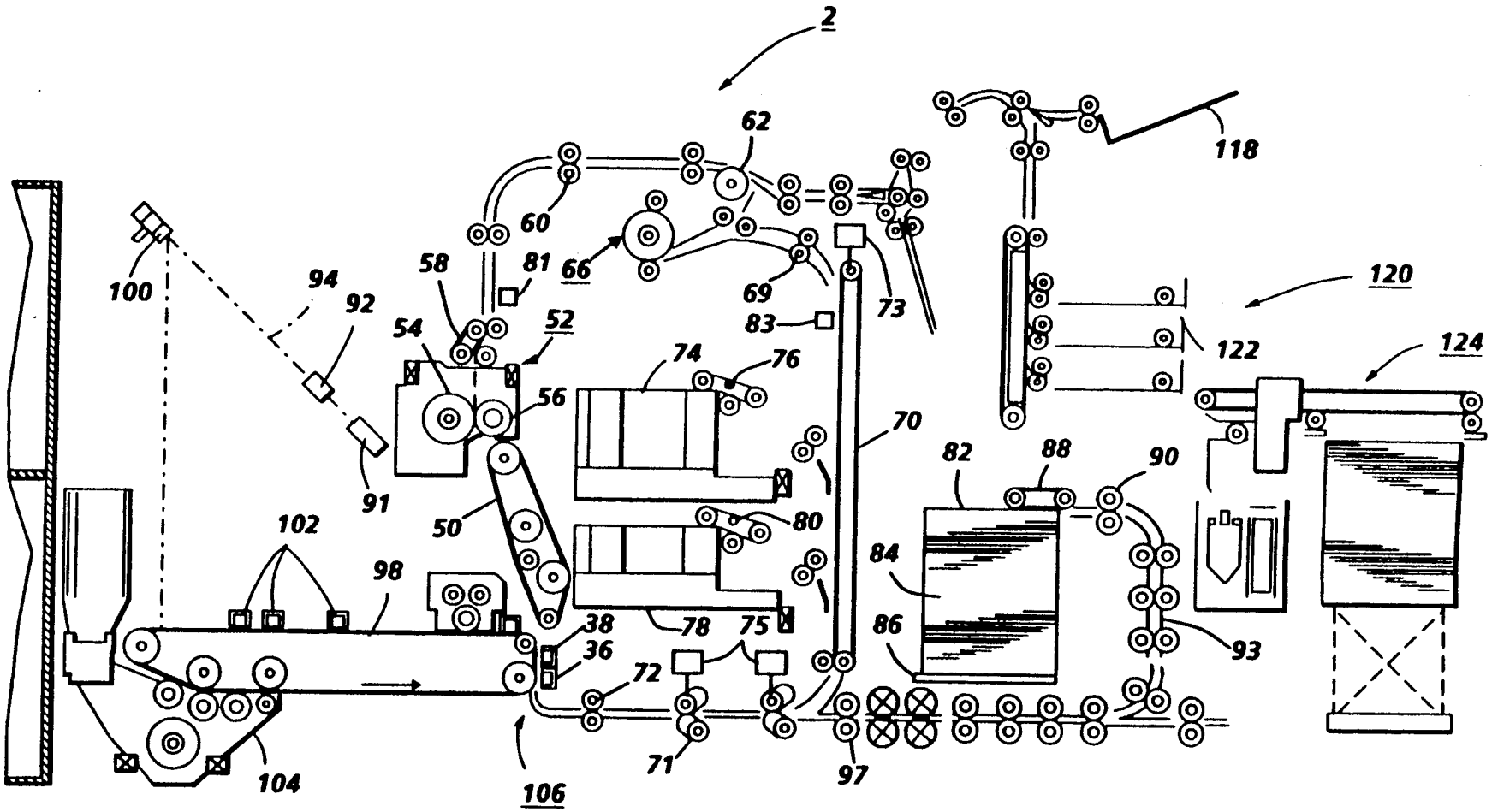
FIG. 1 is a plan view illustrating the principal mechanical components of a typical printing system incorporating the present invention.

Referring to FIG. 1, there is shown an exemplary laser based printing system 2 for processing print jobs in accordance with the teachings of the present invention. Printing system 2 for purposes of explanation is divided into a controller section and a printer section. While a specific printing system is shown and described, the present invention may be used with other types of printing systems such as ink jet, ionographic, etc.

The printer section comprises a laser type printer and for purposes of explanation is separated into a Raster Output Scanner (ROS) section, Print Module Section, Paper Supply section, and Finisher. The ROS has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of the Print Module by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to print media delivered by the Paper Supply section. Print media, as will appear, may comprise any of a variety of sheet sizes, types, and colors. For transfer, the print media or copy sheet is brought forward in timed registration with the developed image on photoreceptor 98 from either a main paper tray high capacity feeder 82 or from auxiliary or secondary paper trays 74 or 78.

A copy sheet is provided via de-skew rollers 71 and copy sheet feed roller 72. Sensor 79 detects the absence or presence of a copy sheet leaving roller 72. At the transfer station 106, the photoconductive belt 98 is exposed to a pre-transfer light from a lamp (not shown) to reduce the attraction between photoconductive belt and the toner powder image. Next, a corona generating device 36 charges the copy sheet to the proper magnitude and polarity so that the copy sheet is tacked to photoconductive belt and the toner powder image attracted from the photoconductive belt to the copy sheet. After transfer, corona generator 38 charges the copy sheet to the opposite polarity to detack the copy sheet from belt.

Following transfer, a conveyor 50 advances the copy sheet bearing the transferred image to the fusing station where a fuser assembly indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Sensor 81 detects the absence or presence of a copy sheet leaving fuser 52. Forwarding rollers 60 then advance the sheet via duplex turn roll 62 to a gate which guides the sheet to output tray 118, finishing station 120 or to duplex inverter 66. The duplex inverter 66 provides a temporary wait station for each sheet that has been printed on one side and on which an image will be subsequently printed on the opposite side. Each sheet is held in the duplex inverter 66 face down until feed time occurs.

To complete duplex copying, the simplex sheet in the inverter 66 is fed back to the transfer station 106 via conveyor 70, de-skew rollers 71 and paper feed rollers 72 for transfer of the second toner powder image to the opposed sides of the copy sheets. Sensor 83 detects the absence or presence of a copy sheet leaving inverter 66. It should be noted that various other suitable sensors distributed throughout the copy sheet path to detect appropriate copy sheet distribution are contemplated within the scope of the present invention and sensors 79, 81, and 83 are merely illustrative. The duplex sheet is then fed through the same path as the simplex sheet to be advanced to the finishing station which includes a stitcher and a thermal binder.

Copy sheets are supplied from the secondary tray 74 by sheet feeder 76 or from secondary tray 78 by sheet feeder 80. Sheet feeders 76, 80 are friction retard feeders utilizing a feed belt and take-away rolls to advance successive copy sheets to transport 70 which advances the sheets to rolls 72 and then to the transfer station.

A high capacity feeder 82 is the primary source of copy sheets. Tray 84 of feeder 82 is supported on an elevator 86 for up and down movement and has a vacuum feed belt 88 to feed successive uppermost sheets from the stack of sheets in tray 84 to take away drive roll 90. Roll 90 guides the sheet onto transport 93 which in cooperation with paper feed roller 97 moves the sheet to the transfer station via de-skew rollers 71 and feed rollers 72.

Figure 2:
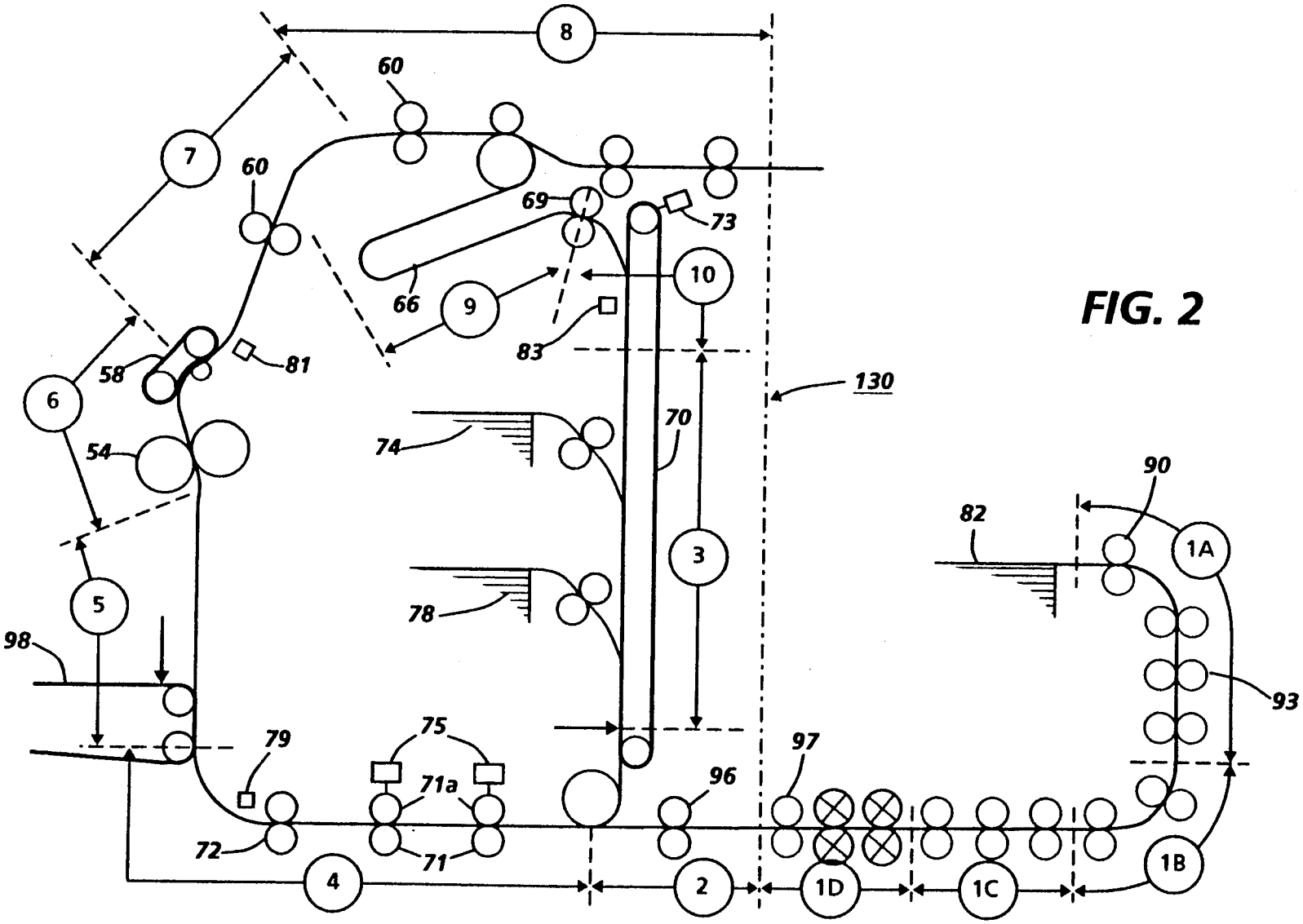
FIG. 2 is an expanded view of the copy sheet path of FIG. 1 in accordance with the present invention.

With reference to FIG. 2, an enlarged sketch of the copy sheet path is illustrated with thirteen predetermined copy sheet paths zones. The zones are identified by the circled numbers, and are defined by the arrows extending from the circled numbers between dotted lines. The dashed line 130 illustrates the interface between the copy handling module and the finisher station 120. Zones 1A through 1D illustrate the copy sheet path from the high capacity feeder 82 to feed roller 97, zone 3 illustrates the copy sheet path along conveyor or transport 70, and zones 2 and 4 illustrate the copy sheet path from feed roller 97 to the transfer station, 106. Zone 5 illustrates the copy sheet path between the transfer station and the fuser 52, zone 6 illustrates the copy sheet path from the fuser to decurler 58, zone 7 illustrates the copy sheet path between the decurler 58 and the rollers 60, zone 8 illustrates the copy sheet path from the rollers 60 to the finishing station, zone 9 illustrates the copy sheet path from the duplex tray 66 to the duplex feed rolls, and zone 10 illustrates the copy sheet path between the duplex feed rolls 69 and the top of the conveyor 70.

In one embodiment of the present invention, zones 5, 6, 7 and 8 are driven by the main drive of the machine, and therefore with the main drive in operation, copy sheets are driven from the transfer station 106 at the photoreceptor 98 to the input to the finishing station 102. Zones 1A through 1D are driven by the high capacity feeder drive 90, to convey copy sheets from the high capacity feeder to engagement with the de-skew rollers 71 and 96 and copy sheets in zone 3 are driven by the transport 70 suitably interconnected to the main drive through the transport clutch 73. Copy sheets in zone 4 are independently driven by a registration servo motor suitably driving the registration rolls 72 as well as by the operation of a cross roll motor driving de-skew rollers 71 suitably engaged to oppositely disposed idler rolls 71*a* by the activation and inactivation of solenoid 75. Finally, copy sheets in the duplex tray are driven by duplex drive rolls 69 into engagement with the transport 70.

It should be noted that the partitions of the copy sheet path into thirteen zones is arbitrary and any number of zones in any configuration is contemplated within the scope of the present invention. Certain portions of the copy sheet path may be independently driven as shown. However, a key feature of the present invention is the timing of a given single drive for copy sheets within the zone of the given drive to enhance jam clearance and recovery. The single sheet path drive may encompass the entire sheet path or only portions of the sheet path.

Single zone jam clearance is significant in paper handling systems for optimal customer satisfaction. A perfect design would eliminate all jams, but when jams occur, it is preferable to make the sheet as easy to remove as possible. In accordance with the present invention, jam clearance is substantially improved by accurately identifying sheet position when a jam occurs, differentiating and defining "Operator Zone" vs. "Clearance Zone", and identifying potential jams that do not meet "single zone" clearance requirements.

Single zone jam clearance can be defined in multiple ways depending on number of sheets cleared and actions required for clearance. In general it means that all sheets in the problem zone must be clearable without excessive effort or access to a second zone. Ideally an operator would go to the zone and remove only the problem sheet, however motor coast and other factors often force removal of multiple sheets. The potential removal of multiple sheets and perceived unreliability of sheets in process often forces purge of all upstream substrate to protect job integrity.

Since action to clear a jam may require opening 1 to n covers and 1 to n baffles, a zone boundary is usually considered the baffle interface. An "Operator Zone" in the usual sense is the traditional definition of zone, i.e., the area required to be opened for paper removal. This may be a cover line, a paper transport baffle, a feeder drawer, or a stacking bin. A "Clearance Zone" is the area a sheet must be resident within to be clearable by the actions of the operator.

Figure 3A:
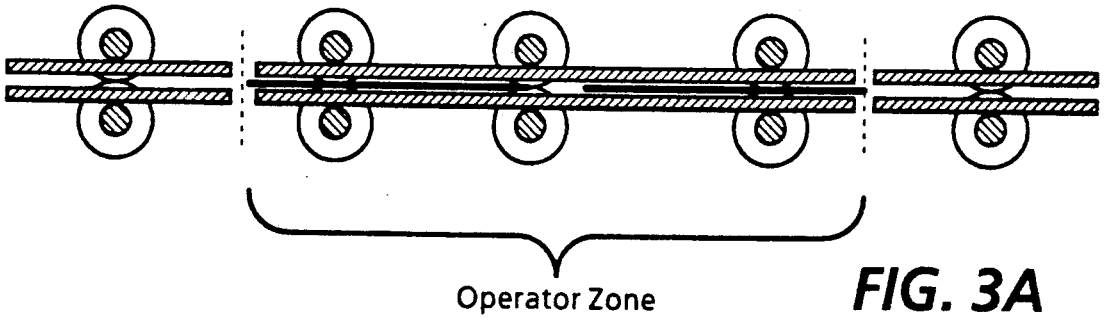
FIGS. 3A and 3B illustrate Operator and Clearance zones in accordance with the present invention.
Figure 3B:
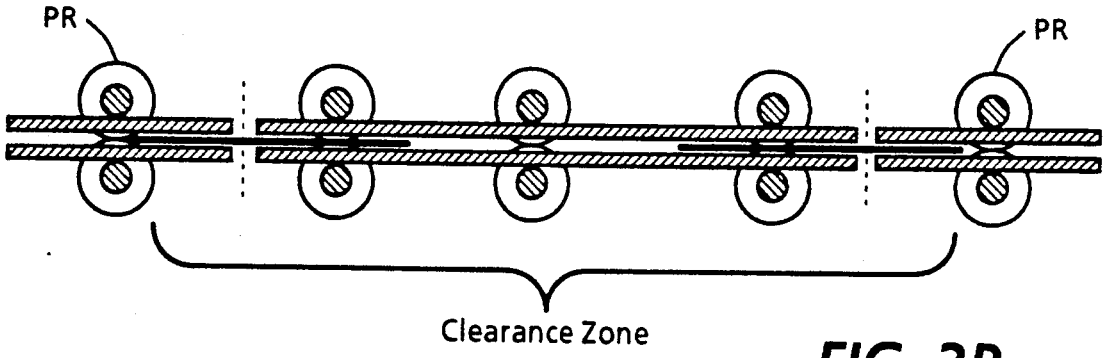

The zone the operator perceives the sheets to be in is shown in FIG. 3, OZ—(Operator Zone), the area under a baffle. However, the true clearance zone, CZ is the extended length from the pinch rolls, PR just prior to and following the operator zone (Clearance Zone). Sheets may reside anywhere within this area and still be easily clearable. Although the baffle in these areas may not open, nothing captures the sheet to prevent its removal. As long as some portion of the sheet extends into the operator zone a sheet can be removed.

The factors which define a clearance zone include Baffle Interfaces, Baffle Open Geometry, Substrate Length, Cover Interfaces, and Paper Pinch Points. It is important to note that sensors do not define a clearance zone but instead provide information as to the location of sheets relative to hardware defined zones.

Figure 4:
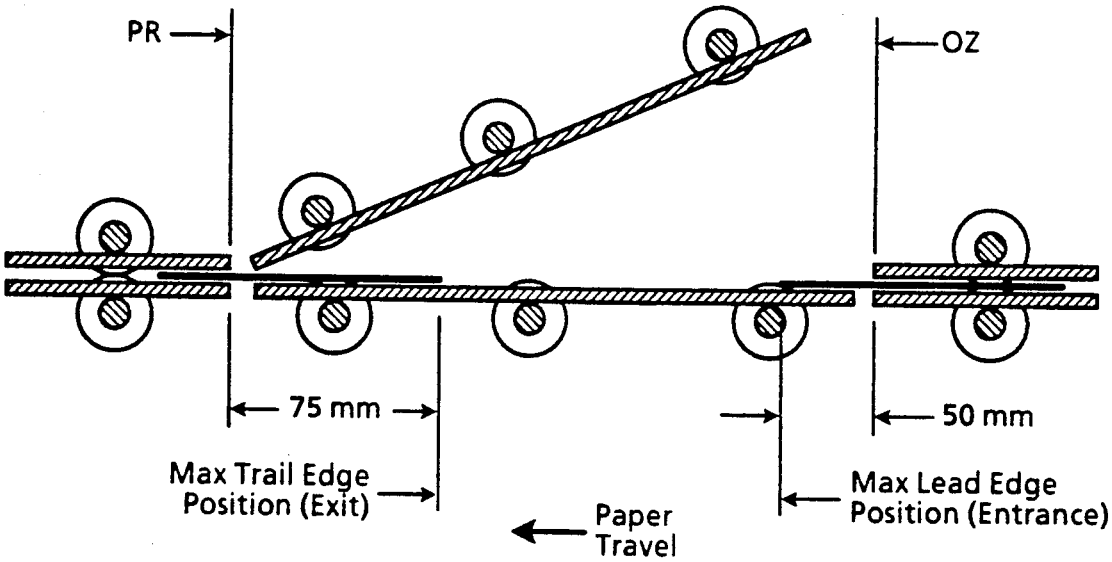
FIG. 4 is an example of baffle geometry in accordance with the present invention.

Baffle interfaces and baffle open geometry define a zone by limiting the extreme positions of a sheet. In general, 50 mm is often the minimum graspable length of sheet for easy removal, but baffle open geometry can affect this length. For example, the baffle in FIG. 4. pivots open at one end only, the pivot point PP. The sheet with full access must extend only 50 mm into the operator zone, however the exit sheet must leave at least 75 mm length for easy removal.

Paper pinch points and the force exerted influence zone definition also. If nip forces are light enough, sheets can be pulled out from captured areas without relieving the pinch point. This extends the clearance zone to the second pinch roller in most paper transports. In areas where "soft" corrugation nips are used, sheets may reside under multiple rollers and still be defined as removable.

Figure 5:
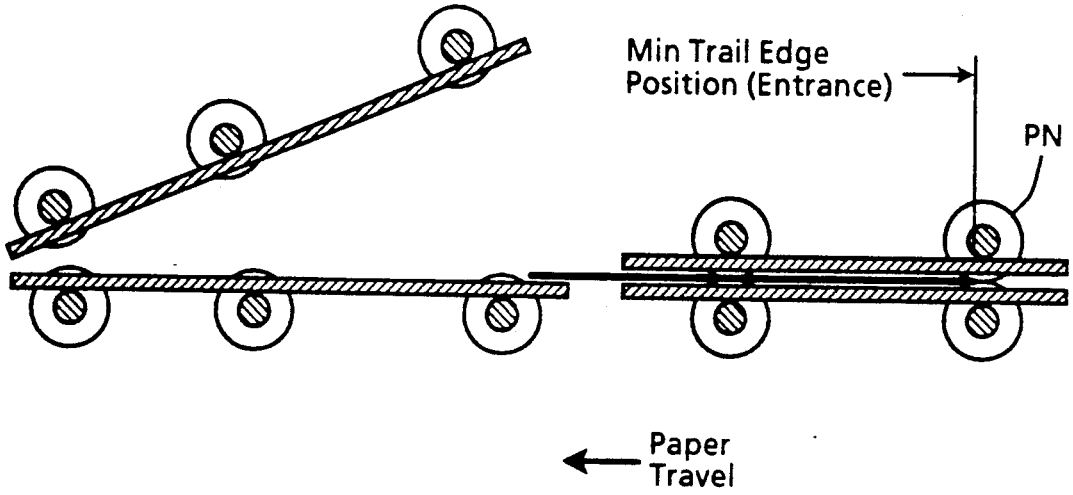
FIG. 5 illustrates extraction of a sheet under multiple nips.

Minimum and maximum paper length also impact clearance zone definition. It may be that the trail edge of a sheet can reside as far back as the second preceding nip, PN as shown in FIG. 5. The trail edge position may be forced forward to satisfy the 50 mm grasp requirement to extract a sheet.

Taking the concept of the "clearance zone" and combining it with information about the jammed sheet position at the time of shutdown, a method has been developed to increase the single zone jam clearance opportunities within a given machine.

In accordance with the present invention, is a method to predict the position of the jammed sheet and control the position of following sheets via a timing delay, in order to enable Single Zone Jam Clearance. The method pinpoints the location of a jammed sheet based on information from the sensor that detected late arrival of the lead or trail edge. The following sheet's un-controlled position can be predicted based on a number of factors including interdocument gap, coast distance, and timing delays. Using both pieces of information, the location range for the jammed sheet and the "natural" stopping position of the following sheet, the location of the following sheet can be controlled via variable fault declaration delays to stop it either outside the jam sheet zone, or fully within the jam sheet zone.

A key to the method is a variable which can be controlled by the machine to enable single zone jam clearance. The variable is partly a safety factor of time added to nominal sheet travel time. For example, if it nominally takes a sheet 400 milliseconds to travel from sensor S1 to sensor S2, a variable of 50 milliseconds might be added to account for variability in arrival time. Therefore, the machine would wait 450 ms to declare a shutdown.

Applying the idea of a VARIABLE fault declaration time allows this "safety factor" to be adjusted to meet the needs of a SINGLE ZONE JAM CLEARANCE algorithm. For example, the variable in theory could range in duration from, 10 ms to 400 ms, depending on the requirements. The SINGLE ZONE JAM CLEARANCE algorithm turns a seemingly arbitrary safety factor into the functional variable controlling the stopping position of sheets.

Figure 6A:
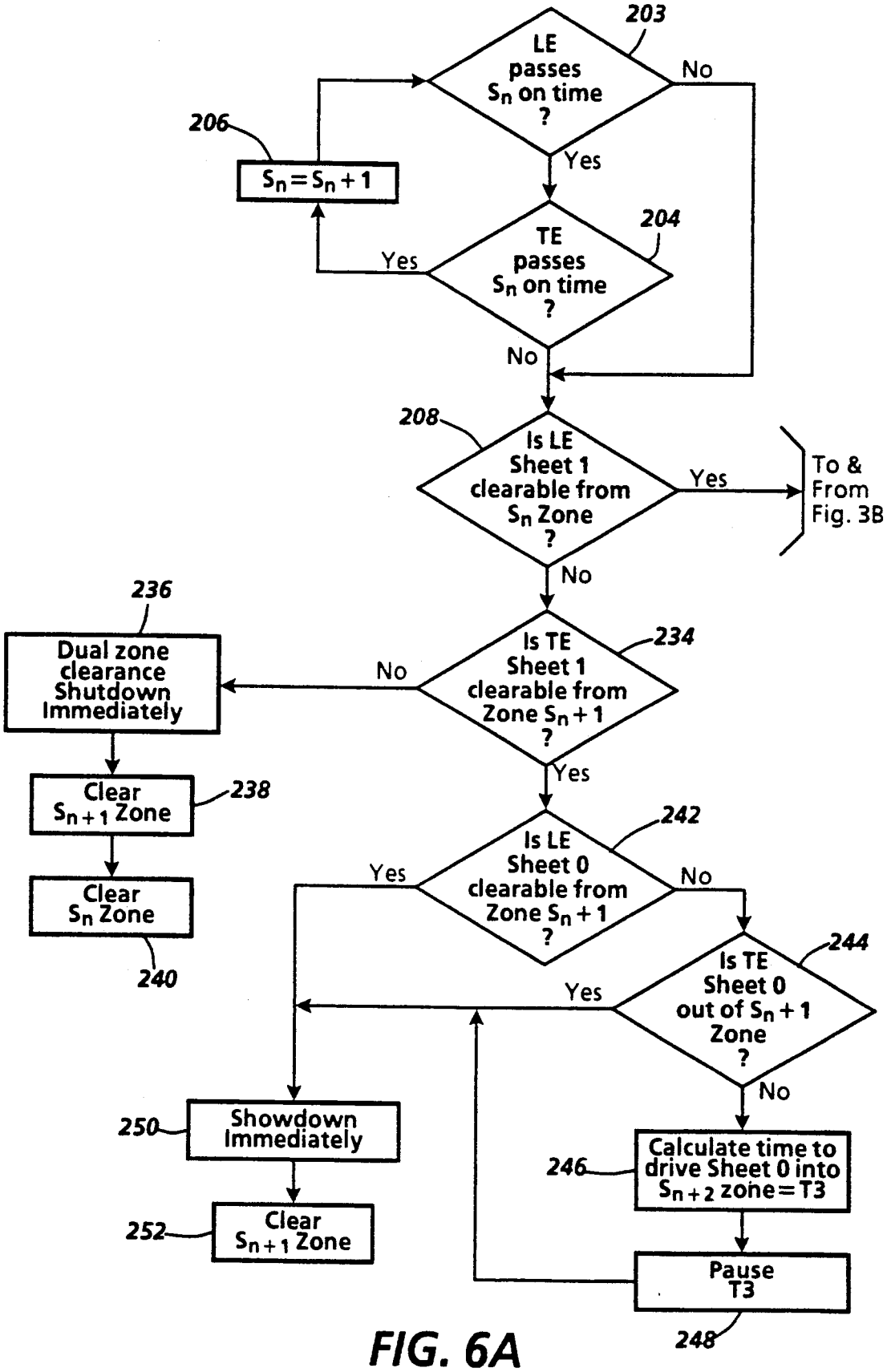
FIGS. 6A and 6B are a flowchart of the jam clearance procedure in accordance with the present invention.
Figure 6B:
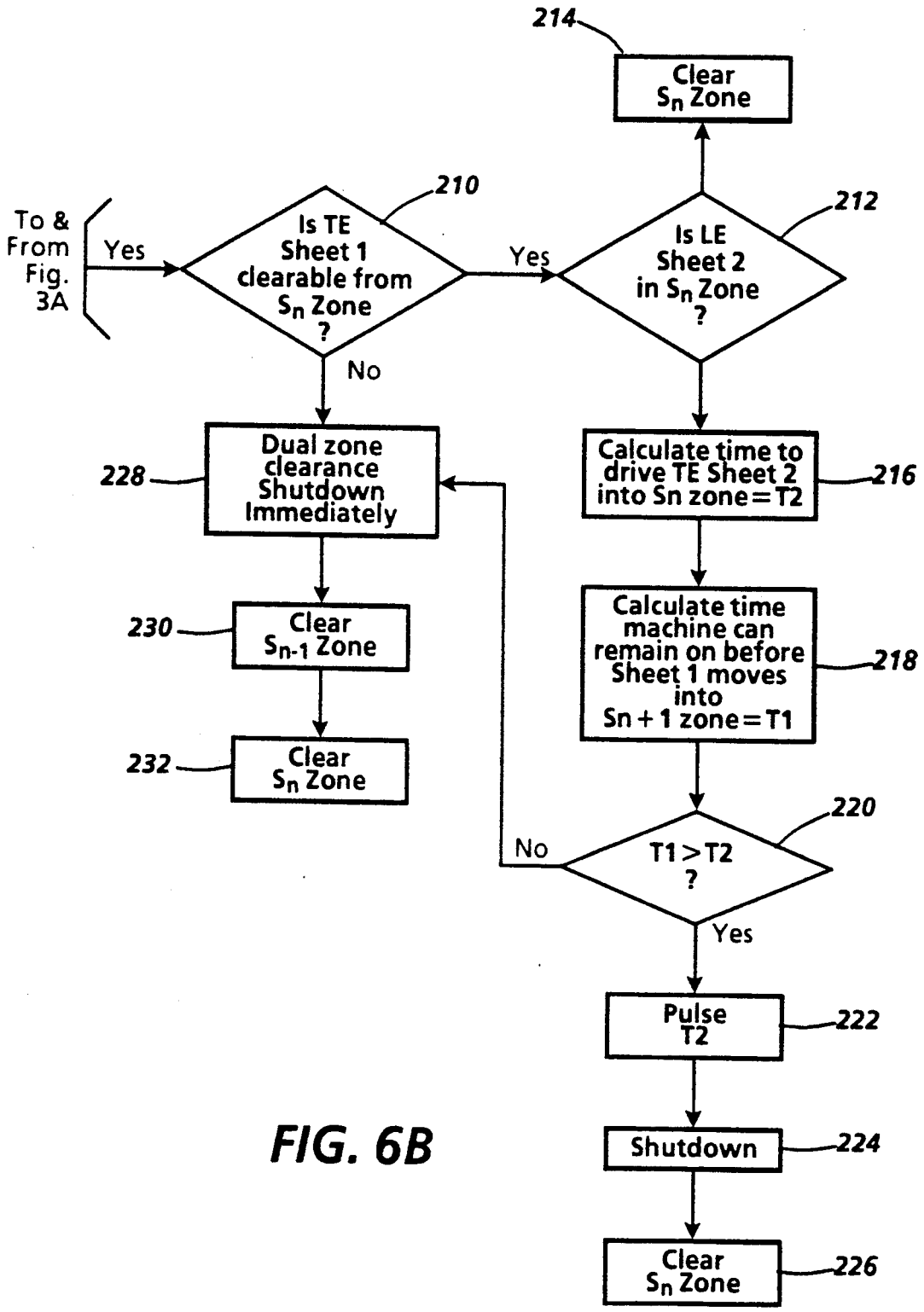

In accordance with the present invention, throughout the system paper path as shown, there are generally a plurality of sensors to track the passage of copy sheets. For purposes of the description of the present invention, assume that sensor $S_n$ is a given sensor in a given zone $S_n$ of the copy sheet path. With reference to FIG. 6, in accordance with the present invention, at each sensor, a decision is made as illustrated at 202 whether or not the lead edge (LE) encounters or triggers a given sensor on time. If the lead edge passes the sensor $S_n$ on time, then there is a decision made as illustrated at block 204 whether or not the trailing edge (TE) passes the sensor $S_n$ on time. If a given copy sheet is successfully sensed by sensor $S_n$, then no particular malfunction or jam of the copy sheet is registered at the zone $S_n$. The same process is repeated as the sheet traverses from the zone or sensor $S_n$ to the sensor $Sn+1$ in zone $S_n+1$ as illustrated at block 206. If the copy sheet is suitably transported through the copy sheet path through the various zones of the copy sheet path, then jam clearance will not be required.

However, if either the lead edge of a given copy sheet or the trail edge of a given copy sheet is not properly sensed at sensor $S_n$, as indicated at either block 202 or block 204, then corrective action is required and additional decisions must be made in accordance with the present invention. In particular, with reference to block 208, a decision is made as to whether or not the lead edge of the sheet identified as sheet number 1 at sensor $S_n$ is clearable from the $S_n$ zone. If the lead edge of sheet 1 is clearable from the $S_n$ zone, then a determination is made as to whether or not the trail edge of sheet 1 is also clearable from the $S_n$ zone as illustrated at block 210. If both the lead edge and trail edge of sheet 1 are clearable from the $S_n$ zone, a final determination is whether or not the lead edge of the sheet that is following sheet 1 (identified as sheet 2) is located in the $S_n$ zone. This decision is illustrated at block 212. If the lead edge of the trailing sheet is not in the $S_n$ zone, then the sheet causing the malfunction, sheet 1, is cleared from the $S_n$ zone as shown at block 214. In other words, there is clearance from a single zone of the machine known as single zone clearance.

On the other hand, with reference to block 212, if the lead edge of the sheet 2 is in the $S_n$ zone, then a potential situation of two zone clearance may be required. That is, if the lead edge of sheet 2 is in the $S_n$ zone, the trail edge of the sheet 2 may extend back into a previous zone. In fact, the trail edge of sheet 2 may be secured in a roller nip zone $S_{n-1}$. In this situation, while clearing sheet 1 from zone $S_n$, it may be necessary to go into the previous zone identified as zone $S_n-1$ in order to clear sheet 2. This is undesirable because of the time and disruption of the machine in order to clear for multiple zones.

In accordance with the present invention, if there is a determination that the lead edge of sheet 2 is, in fact, in the $S_n$ zone, then the machine control calculates or determines the time (T2) necessary to drive sheet 2 in the $S_n$ zone. In other words, a sufficient time T2 is determined to be able to drive sheet 2 to a position in zone $S_n$ for sheet 2 to be cleared from zone $S_n$. This determination is made because it would be desirable to be able to drive a sheet such as copy sheet 2 into a common zone $S_n$ as the jamming sheet 1 for single zone clearance. However, it is also necessary to calculate machine time (T1) that the machine can be in operation before sheet 1 is driven into the zone next following zone $S_n$, that is, zone $S_n+1$, as shown in block 218.

The difference between times T2 and T1 is determined as illustrated at block 220. If the time T1 is greater than the time T2, then the time that it would take to drive sheet 1 into the next following zone $S_n1$ is greater than the time T2 that it would take to drive sheet 2 sufficiently into the $S_n$ zone for removal. In this situation, the machine is operated for a time T2 as shown at block 222. This machine time called pause T2 is sufficient to drive sheet 2 into the $S_n$ zone and yet not of sufficient length to drive sheet 1 into zone $S_n+1$. After the pause or time period T2, the machine is cycled or shut down as shown at block 224 and sheets 1 and 2 are cleared from the $S_n$ zone as shown at block 226.

On the other hand, if time T1 is not greater than time T2, that is, for the time necessary to drive sheet 2 into the $S_n$ zone would also drive sheet 1 into the zone $S_n+1$, then dual zone clearance would be necessary as illustrated at block 228. Preferably, there is an immediate shutdown leaving sheet 1 in zone $S_n$ with sheet 2 at least partially in zone $S_n-1$. Sheet clearance will be from both zones $S_n$ and $S_n-1$. An alternative might be to drive sheet 1 into zone $S_n+1$ and sheet 2 into zone $S_n$. This might be appropriate if zones $S_n$ and $S_n+1$ are more amenable to operator access. In general, however, less machine cycle down time or pause time is desirable in order to clear the machine. As illustrated at block 228, there is an immediate shutdown and as shown at blocks 230 and 232 zones $S_n$ and $S_n-1$ are cleared if the time T1 is not greater than the time T2 as determined at block 220.

With reference again to block 208, if the lead edge of sheet 1 is not clearable from zone $S_n$, then a determination is made at block 234 whether or not the trail edge of sheet 1 is clearable from zone $S_n+1$. In other words, if the lead edge of sheet 1 is not clearable from zone $S_n$, it is assumed that the lead edge of sheet 1 has already passed into zone $Sn+1$ and is presumably clearable from zone $S_n+1$. In this case, it would still be necessary to determine as illustrated at block 234 whether or not the trail edge of sheet 1 is also clearable from zone $S_n+1$. If the trailing edge of sheet 1 is not clearable from zone $S_n+1$, then a dual zone clearance situation is indicated as illustrated at block 236. In other words, both zones $S_n+1$ and $S_n$ must be accessed to clear sheet 1.

If on the other hand, the trailing edge of sheet 1 is clearable from zone $S_n+1$, as shown at block 234 and the lead edge of sheet 1 is not clearable from the $S_n$ zone, illustrated at block 208, then it is assumed that sheet 1 is clearly within the zone $S_n+1$ and clearable from zone $S_n+1$. However, the status of the sheet immediately ahead of sheet 1 also must be taken into consideration with respect to zone $S_n+1$. In particular, as shown at block 242, a decision is made whether or not the lead edge of the preceding sheet (sheet 0) is clearable from zone $S_n+1$.

If the lead edge of sheet 0 is not clearable from zone $S_n1$, then it is assumed that the lead edge of sheet 0 is in zone $S_n+2$. In this case, a determination then is made as to whether or not the trail edge of sheet 0 has also exited zone $S_n+1$ as shown at block 244. If the trail edge of sheet 0 has not exited at zone $S_n+1$, that is, the trail edge of sheet 0 remains in zone $S_n+1$, then there is a calculation of the time necessary to drive sheet 0 into zone $S_n+2$. This time is designated time T3. The machine then pauses for a time period T3 as illustrated at block 248 to drive sheet 0 into zone $S_n+2$. It should be noted that the assumption is made that sheet 1 remains clearable from zone $S_n+1$. There is then an immediate shutdown illustrated at block 250 and the zone $S_n+1$ is cleared. On the other hand, as illustrated at block 244, if the trail edge of the sheet 0 is already out of the $S_n+1$ zone, there is no need for a pause T3 and there can be an immediate shutdown and clearance of zone $S_n+1$.

It should be noted that the above example is merely one scenario of many scenarios for converting potentially multi-zone clearance situations into a single zone clearance situation. Various assumptions can be made about the location of copy sheets relative to various zones and in overlapping or multi-zone positions. Also, the ease of access of given zones or a priority of access of zones can be taken into consideration as well as independent or multi-drives for various portions or sections of the copy sheet path. The degree of restraint of a copy sheet in various roller nips is also a factor in exercising single zone clearance. The essence of the invention, however, is a method that simplifies jam clearance, in particular, by reducing access and clearance to a single zone rather than necessitating clearance of multiple zones.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

I claim:

1. In an image processing apparatus for producing images on copy sheets, the apparatus including a copy sheet path defined by a plurality of copy sheet clearance zones, a copy sheet drive, and a controller for directing the image processing apparatus, the controller tracking the movement of the copy sheets along the copy sheet path by reference to the clearance zones, the clearance zones being the zones of access for removal of copy sheets from the copy sheet path, the method of recovery from a jam of a first copy sheet in a first clearance zone comprising the steps of:

determining the stopped position of the first copy sheet;

estimating the stopping position of the first copy sheet, if not jammed, during a machine cycle down;

specifying the stopping position of a second copy sheet, the second copy sheet trailing the first copy sheet in the copy sheet path;

calculating the position of the trail edge for the second copy sheet;

comparing the lead edge of the second copy sheet to the first clearance zone;

comparing the trail edge of the second copy sheet to the first clearance zone;

if the trail edge of the second copy sheet is within the first clearance zone, then immediately shutting down the machine for accessing the first and the second copy sheets from the first clearance zone; and if the trail edge of the second copy sheet is within a second clearance zone, then calculating a time period to continue machine operation to drive the second copy sheet along the copy sheet path for access from the first clearance zone.

2. The method of claim 1 including the step of determining that said time period does not exceed a maximum time period.

3. In an image processing apparatus for producing images on copy sheets, the apparatus including a copy sheet path defined by a plurality of copy sheet clearance zones, a copy sheet drive, and a controller for directing the image processing apparatus, the controller tracking the movement of the copy sheets along the copy sheet path by reference to the clearance zones, the clearance zones being the zones of access for removal of copy sheets from the copy sheet path, the method of recovery from a jam of a first copy sheet in a first clearance zone comprising the steps of:

determining the stopped position of the first copy sheet;

specifying, the stopping position of a second copy sheet, the second copy sheet trailing the first copy sheet in the copy sheet path;

calculating the position of the trail edge for the second copy sheet;

comparing the trail edge of the second copy sheet to the clearance zones; and if the trail edge of the second copy sheet is within a second clearance zone, then calculating a time period to continue machine operation to drive the second copy sheet for access from the first clearance zone.

4. The method of claim 3 including the step of estimating the stopping position of the first copy sheet, if not jammed, during a machine cycle down.

5. The method of claim 3 including the step of immediately shutting down the machine for accessing the first and the second copy sheets from the first clearance zone if the trail edge of the second copy sheet is within the first clearance zone.

6. The method of claim 3 including the step of determining that said time period exceeds a maximum set time period and in response determining that said time period exceeds a maximum set time period stopping operation of the image processing apparatus.

7. In an image processing machine for producing images on copy sheets, the apparatus including a copy sheet path defined by a plurality of copy sheet clearance zones, a copy sheet drive, and a controller for directing the image processing apparatus, the controller tracking the movement of the copy sheets along the copy sheet path by reference to the clearance zones, the clearance zones being the zones of access for removal of copy sheets from the copy sheet path, the method of recovery from a jam of a first copy sheet in a first clearance zone comprising the steps of:

determining the position of the first copy sheet and a second copy sheet in the copy sheet path;

recognizing that the second copy sheet is within a second clearance zone;

calculating a time period to continue machine operation to drive the second copy sheet into the first clearance zone; and determining that said time period does not exceed a maximum time period.

8. In an image processing apparatus for producing images on copy sheets, the apparatus including a copy sheet path having a plurality of zones, a copy sheet drive, and a controller for directing the image processing apparatus, the method of recovery from a copy sheet jam wherein at least one in process copy sheet is disposed along said copy sheet path, the in process copy sheet extending from said given zone to another zone, comprising the steps of:

monitoring the location of the in process copy sheet within the plurality of zones;

detecting a machine malfunction;

responding to the malfunction and to the location of the in process copy sheet to operate the copy sheet drive a given period of time dependent upon the location of the in process copy sheet with respect to a given zone; and positioning the in process copy sheet within the copy sheet path for access from said given zone including the step of determining the degree of restraint of the in process copy sheet within said another zone.

9. In an image processing apparatus for producing images on copy sheets, the apparatus including a copy sheet path having a plurality of zones, a copy sheet drive, and a controller for directing the image processing apparatus, the method of recovery from a copy sheet jam wherein at least one in process copy sheet is disposed along said copy sheet path comprising the steps of:

monitoring the location of the in process copy sheet within the plurality of zones;

detecting a machine malfunction;

responding to the malfunction and to the location of the in process copy sheet to operate the copy sheet drive a given period of time dependent upon the location of the in process copy sheet with respect to a given zone; and positioning the in process copy sheet within the copy sheet path for access from said given zone.

10. The method of claim 9 wherein the in process copy sheet extends from said given zone to another zone and wherein the step of positioning the in process copy sheet within the copy sheet path for access from said given zone includes the step of removing the in process copy sheet from the copy sheet path via said given zone.

11. The method of claim 9 wherein the in process copy sheet extends from said given zone to another zone and the step of positioning the in process copy sheet within the copy sheet path includes the step of determining the degree of restraint of the in process copy sheet within said another zone.

12. The method of claim 9 wherein the step of determining the degree of restraint of the in process copy sheet within said another zone includes the step of determining the degree of grip of the in process copy sheet within a sheet drive nip.

13. The method of claim 9 wherein one of the zones is the paper path from a transfer station to an output tray.

14. The method of claim 9 wherein one of the zones is the paper path from a copy sheet supply to a sheet registration location.

15. In an image processing apparatus for producing images on copy sheets, the apparatus including a copy sheet path defined by a plurality of copy sheet clearance zones, a copy sheet drive, and a controller for directing the image processing apparatus, the controller tracking the movement of the copy sheets along the copy sheet path by reference to the clearance zones, the clearance zones being the zones of access for normal removal of copy sheets from the copy sheet path, the copy sheet path also being defined by a plurality of expanded access zones, an expanded access zone being a zone of expanded access to copy sheets to remove sheets from the copy sheet path, a given expanded access zone encompassing portions of a plurality of sheet clearance zones, the method of recovery from a copy sheet jam wherein at least one in process copy sheet is disposed along said copy sheet path, comprising the steps of:

monitoring that the in process copy sheet extends from a first clearance zone to a second clearance zone;

evaluating the force exerted on the in process copy sheet in the second clearance zone;

determining that the in process copy sheet is in an expanded access zone; and removing the in process copy sheet by access to said first clearance zone.

16. The method of claim 15 wherein the step of evaluating the force exerted on the in process copy sheet in the second clearance zone includes the step of evaluating copy sheet contact points.

17. The method of claim 15 wherein the step of evaluating the force exerted on the in process copy sheet in the second clearance zone includes the step of evaluating copy sheet pinch points in a nip.

18. The method of claim 15 wherein the step of determining that the in process copy sheet is in an expanded access zone includes the step of determining the amount of the copy sheet available to grasp.

19. The method of claim 15 wherein the step of determining that the in process copy sheet is in an expanded access zone includes the step of determining the length of the copy sheet.

20. The method of claim 15 including the step of driving the in process copy sheet for a given time period after detection of a jam.

21. In an image processing apparatus for producing images on copy sheets, the apparatus including a copy sheet path defined by a plurality of copy sheet clearance zones, a copy sheet drive, and a controller for directing the image processing apparatus, the controller tracking the movement of the copy sheets along the copy sheet path by reference to the clearance zones, the clearance zones being the zones of access for normal removal of copy sheets from the copy sheet path, the method of recovery from a copy sheet jam wherein at least one in process copy sheet is disposed along said copy sheet path, comprising the steps of:

monitoring that the in process copy sheet extends from a first clearance zone to a second clearance zone;

evaluating the force exerted on the in process copy sheet in the second clearance zone; and selecting between a first and a second option, the first option including the step of driving the copy sheet into the first clearance zone for removal, the second option including the step of leaving the copy sheet partially in the second clearance zone for removal from the first clearance zone.

* * * * *